US008215511B1

(12) United States Patent
Lin

(10) Patent No.: US 8,215,511 B1
(45) Date of Patent: Jul. 10, 2012

(54) LATCHED HANDLE CONTAINER LID

(76) Inventor: Shin-Shuoh Lin, Laguna Hills, CA (US)

( * ) Notice: Subject to any disclaimer, the term of this patent is extended or adjusted under 35 U.S.C. 154(b) by 415 days.

(21) Appl. No.: 12/459,210

(22) Filed: Jun. 29, 2009

(51) Int. Cl.
*B65D 25/18* (2006.01)

(52) U.S. Cl. ..... 220/212.5; 220/253; 220/254.1; 220/254.8; 220/255; 220/259.3; 220/288; 220/304; 220/378; 220/703; 220/710.5; 220/711; 222/509; 222/518; 215/228; 215/387; 215/396

(58) Field of Classification Search ..... 220/253, 220/254.1, 254.8, 255, 259.3, 288, 304, 378, 220/703, 711, 710.5, 212.5; 215/228, 387, 215/396; 222/509, 518
See application file for complete search history.

(56) References Cited

U.S. PATENT DOCUMENTS 5,390,919 A * 2/1995 Stubbs et al. ..... 473/246
5,433,339 A 7/1995 Sarver
6,202,877 B1 3/2001 La Torre et al.
6,662,978 B2 * 12/2003 Lin et al. ..... 222/509
6,913,159 B1 7/2005 Goldberg
D509,408 S 9/2005 Ward et al.
7,021,486 B1 4/2006 Hurlbut
7,416,093 B2 8/2008 Lin et al.
D588,002 S 3/2009 D'Amato
D592,913 S 5/2009 Pinelli et al.
2004/0217139 A1 * 11/2004 Roth et al. ..... 224/148.7
2010/0282703 A1 * 11/2010 Yang ..... 215/228
* cited by examiner

*Primary Examiner* — Anthony Stashick
*Assistant Examiner* — Elizabeth Volz
(74) *Attorney, Agent, or Firm* — Gordon K. Anderson

(57) ABSTRACT

A container lid with a latch handle is taught that incorporates a drinking lip, having a flared brim, configured to interface with a liquid container. A lip sealing ring is disposed on the drinking lip creating a watertight fit between the lip and the container. A lid body, having lid male threads, is configured to interface with container lid female threads, and the lid body includes a bottom cover which forms a dead air space for insulation purposes within the lid. The lid body incorporates a vertical arched handle with a snap-in hinged spring loaded latch for quick release attachment of the container lid and container securely to an object. A lid sealing ring is disposed on the lid body forming a watertight fit between the lid body and the container drinking lip.

12 Claims, 4 Drawing Sheets

LATCHED HANDLE CONTAINER LID

TECHNICAL FIELD

The present invention relates to container lids in general. More specifically to a liquid container lid with a vertical arched handle including a spring loaded latch for quick attachment to an article or structure.

BACKGROUND OF THE INVENTION

Previously, many types of lids or covers have been used in endeavoring to provide an effective means to enclose a container in a removable manner.

The prior art listed below did not disclose patents that possess any of the novelty of the instant invention; however the following U.S. patents are considered related:

| U.S. Pat. No. | Inventor | Issue Date |
|---|---|---|
| 5,433,339 | Sarver | Jul. 18, 1995 |
| 6,202,877 B1 | La Torre et al. | Mar. 20, 2001 |
| 6,662,978 B2 | Lin et al. | Dec. 16, 2003 |
| 6,913,159 B1 | Goldberg | Jul. 5, 2005 |
| D 509,408 S | Ward et al. | Sep. 13, 2005 |
| 7,021,486 B1 | Hurlbut | Apr. 4, 2006 |
| 7,416,093 B2 | Lin et al. | Aug. 26, 2008 |
| D 588,002 S | D'Amato | Mar. 10, 2009 |
| D 592,913 S | Pinelli et al. | May 26, 2009 |

Sarver in U.S. Pat. No. 5,433,339 teaches a cylindrical drinking vessel having a pair of integrally formed circumferential grooves and a pair of vertically oriented parallel handle support braces on its outer surface. A carabiner, or rope connection latched oval or a D-shaped ring fits between the handle support braces in a position to straddle the circumferential grooves. A pair of flexible bands are releasably fastened though the carabiner and around the vessel to secure the carabiner as a handle.

U.S. Pat. No. 6,202,877 B1 issued to La Torre et al. provides a lip-openable lid for use in a container having a valve seat and an opening for egress of container contents. A container is also provided to employ the lid which has a gasket with an annular wall, a central portion radially inward of the wall and a peripheral flange engagable with the valve seat. The lid includes a rigid support that has liquid flow openings which supports the central portion of the gasket and positions the gasket against the valve seat.

Lin et al. in U.S. Pat. No. 6,662,978 B2 discloses a liquid storage vessel stopper having interchangeable plugs that utilizes stopper body with an inner shell affixed to an outer shell. The inner shell is configured to communicate with a liquid storage vessel interior and the outer shell is profiled to be threadably attached to the vessels outside surface. An interchangeable stopper plug is either a twist to pour plug or a push to pour plug type, the former has a main core smaller than the inner shell and incorporates a lid creating a dead air space forming an insulating barrier. When the main core is manually rotated at least a quarter of a turn the plug is unseated and a flow path is opened.

Goldberg in U.S. Pat. No. 6,913,159 B1 teaches a water bottle strap that provides a manual engagement for bottles. A handle is defined from a substrate defining holes through which fingers or other digits may pass. The handle is held in tension along the side of the bottle by a top loop engaging the neck of the bottle and a base loop engaging the base of the bottle. The top loop and base loop are connected to the handle by means of an upper and lower connecting segment. Each strap is made of flexible and stretchable material so as to snugly engage the bottle in tension.

U.S. Pat. No. 7,021,486 B1 issued to Hurlbut is for a drinking flask cap having a three-position push-pull lid. The top of the lid forms a drinking basis and the drinking basis can be sealed with a hygienic cap. The cap can be removed and placed on the bottom of the flask of storage and provides a stable base for the flask. A bottle portion of the flask is preferably made form a molded plastic material and can be provided with a finger hold such that the flask can be drunk from in a manner similar to a coffee cup.

U.S. Pat. No. 7,416,093 B2 in U.S. patent Lin et al. discloses a container having a controlled opening lid that includes a container body with an open end providing access to an interior space configured to receive user supplied contents and a lid member configured to cover the open end of the container body when in a first position and permit access to the interior space when in a second position. A hinge is configured to move the lid member from the first position to the second position, the hinge including at least one dampening mechanism for damping a biasing force provided by the hinge when the lid member moves from the first position to the second position.

For background purposes and as indicative of the art to which the invention is related reference may be made to the remaining cited design patents issued to Ward et al. in U.S. Pat. D509,408 S, D'Amato in U.S. Pat. D588,002 S and Pinelli et al. in U.S. Pat. D592,913 S.

BRIEF SUMMARY OF THE INVENTION

There are enormous numbers of containers, bottles and beverage glasses used for containing liquids for transportation that require lids permitting drinking directly from the container and yet providing a stopper that seals the liquid inside.

While the vast majority of lids are provided for static usage such as a screw on lid that may removed when required but lacks the ability to be attached to an article conveniently. The prior art has attempted to include this attachable utility in many ways such as adding a horizontal loop or vertical tab on the top as well as some type of handle positioned on the top with and opening for attachment.

The need has been long felt to perfect this attachment ability, therefore it is a primary object of the invention to incorporate an integral arched vertical handle on the top of the lid with a snap-in spring loaded latch integrated with a quick release attachment mechanism. The vertical handle is positioned directly on the top of the lid permitting the container to hang straight down when attached to an object. Some containers on the market today have lids with a loop incorporated in the lid that are positioned on one side in an horizontal direction, as represented in plastic hydration bottles made by "CONTIGO MUGS". While the prior art lids have purpose, the location of the loop leads something to be desired.

The present invention utilizes an arched handle that has a parabolic shape limiting the container, with the lid attached, from swinging too and fro which is a problem if the handle were semi-circular or even oval in shape. The parabolic shape positions the vertical centerline by gravity to a point nearly in the middle of the article thereby greatly diminishing the swinging problem.

By having the latch handle arched in the shape much like the half of a modern carabiner the user easily recognizes its use particularly when the interface is formed in a typical mushroom shape used on high grade apparatus. Since the latch snaps back in place when released under spring pressure the lid may be attached to a person's belt or belt loop even without looking and attachment becomes almost automatic with one hand when applied to a rigid object. The invention is made of a strong, sturdy, thermoplastic material making it durable and long lasting.

An important object of the invention permits the lid to be used with type of conventional bottle made of any material, and functions particularly well on stainless steel double wall insulated bottles popular in today's market.

Another object of the invention is that the container lid contains a dead air space integrally formed in the lid body which acts as a light weight insulation decelerating the thermal heat transfer for either hot or cold liquids stored within the container.

Still another object of the invention is that there are two parts of the lid, the drinking lip that attaches directly to the container, locking in one half turn onto the container and a lid body with the arched handle that attaches to the lip using threads that lock in a quarter turn. If the user loosely torques the lid parts together and rotates the lid body using the handle, the body is removed first with the quarter turn leaving the lip on the container as it requires further rotation for removal.

A further object of the invention is the attractive appearance of the lid since both components together create smooth contours and interface with no sharp edges or opening apparatus. Further the flared drinking lip is smooth and comfortable to use.

Yet another object of the invention is that the lid includes a covered lip bottom that prevents splashing and avoids being hit in the mouth with ice when drinking as the bottom has only a single opening large enough for liquid to flow freely and yet is small enough to retain the ice.

A final object of the invention is the ease of cleaning since the body is completely removed when drinking thereby eliminating any complex sealing openings requiring sliding members, levers, push buttons, hinges and the like which inadvertently create areas that are inaccessible and hard to clean.

These and other objects and advantages of the present invention will become apparent from the subsequent detailed description of the preferred embodiment and the appended claims taken in conjunction with the accompanying drawings.

DETAILED DESCRIPTION OF THE INVENTION

Figure 1:
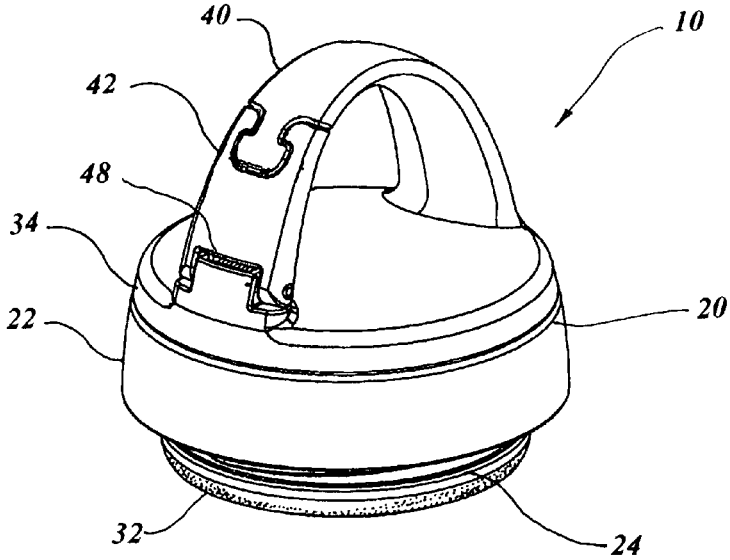
FIG. 1 is an isometric view of the container lid with a latch handle in the preferred embodiment.
Figure 2:
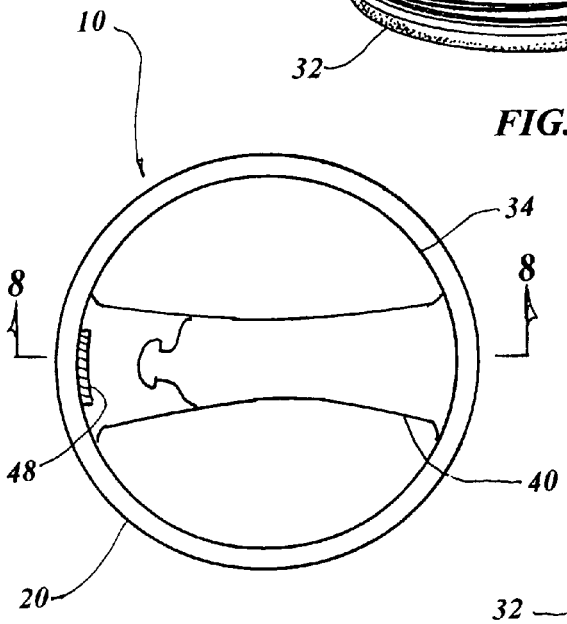
FIG. 2 is a top plan view of the container lid in the preferred embodiment.

The best mode for carrying out the invention is presented in terms of a preferred embodiment of a container lid with a latch handle 10. This preferred embodiment is shown in FIGS. 1 thorough 17 and is comprised of a drinking lip 20 having a flared brim 22 with the lip 20 configured to interface with a liquid container, (not illustrated). The lip 20, shown in FIGS. 1 and 4-9, includes female threads 24 that are configured to contiguously engage and seal against the container when the drinking lip 20 is rotated from 170 degrees to 190 degrees.

Figure 3:
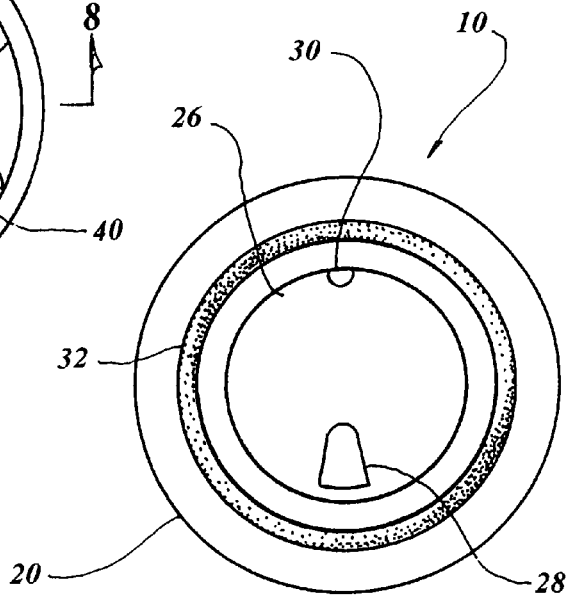
FIG. 3 is a bottom view of the container lid in the preferred embodiment.
Figure 4:
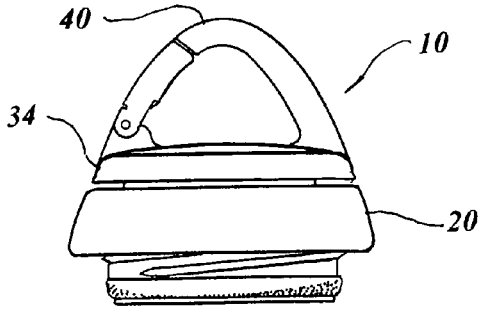
FIG. 4 is a front elevation view of the container lid in the preferred embodiment.
Figure 5:
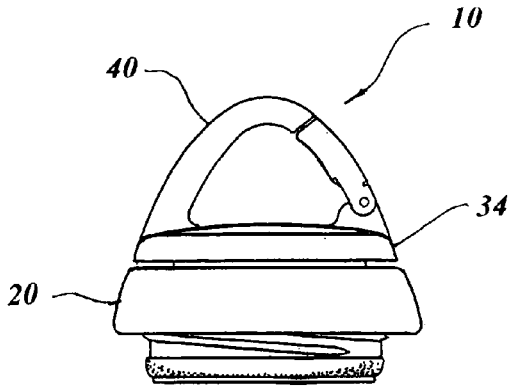
FIG. 5 is a rear elevation view of the container lid in the preferred embodiment.
Figure 6:
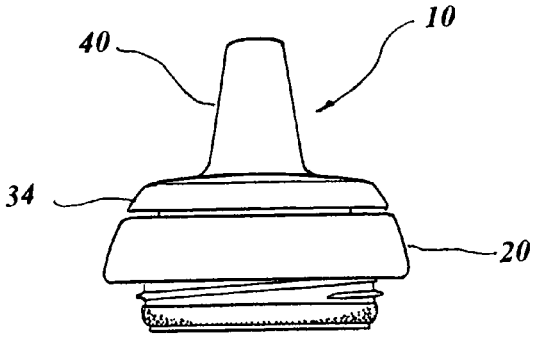
FIG. 6 is a right side view of the container lid in the preferred embodiment.
Figure 7:
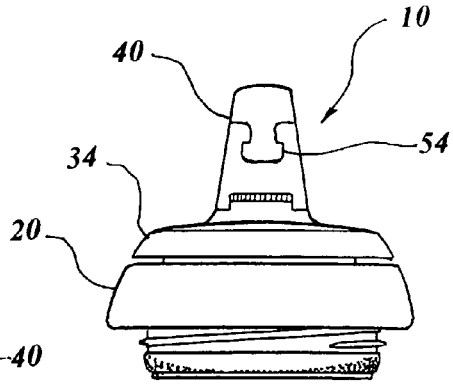
FIG. 7 is a left side view of the container lid in the preferred embodiment.

A lip bottom portion 26 is incorporated in the lip 20 having both a liquid aperture 28 and a vent opening 30, with the vent opening 30 located at an opposed location from liquid the liquid aperture 28, as illustrated in FIG. 3. The drinking lip 20 is formed from a thermoplastic material consisting of acrylic, allyl diglycol carbonate, polycarbonate, polystyrene, polysulfone, polyester sulfone or polyester.

A lip sealing ring 32 is disposed onto the drinking lip 20 permitting a watertight to fit between the drinking lip 20 and the container. The lip sealing ring 32 is depicted in FIGS. 4-8, 10 and 17 and is preferably made of a silicone material.

A lid body 34 incorporates lid male threads 36 that are configured to interface with the drinking lip female threads 24. The lid body male threads 36 contiguously engage and seal against the drinking lip female threads 24 when the lid body 34 is rotated from 85 degrees to 95 degrees, approximately a quarter of a turn, and finally 170 degrees to 190 degrees. A bottom cover 38 is incorporated into the lid body 34 forming an insulated dead air space adding to the utility of the container lid 10. The bottom cover 38 is illustrated best in the cross section of FIG. 8. The lid body 34 is formed from a thermoplastic material consisting of acrylic, allyl diglycol carbonate, polycarbonate, polystyrene, polysulfone, polyester sulfone or polyester.

The novelty and uniqueness of the invention is the addition of an appendage in the form of an integral arched handle 40 positioned vertically on the top of the lid body 34 providing not only an operating handle for access to the container but a method of attaching the lid, along with the container, to an article of clothing or a fixed object such as a belt, belt loop, rigid structure and the like. The arched handle 40 preferably has a parabolic shape $\mathbf{40}^{a}$ with a thickness and width at distal ends larger than at its apex, The arched handle 40 having radial distal ends integrally merging smoothly into the lid body, and the parabolic shape $\mathbf{40}^{a}$ having a surface intersecting with the vertically flared brim 22 of the drinking lip 20 forming a continuation of the parabolic shape $\mathbf{40}^{a}$ as illustrated in FIGS. 4-7.

Figure 12:
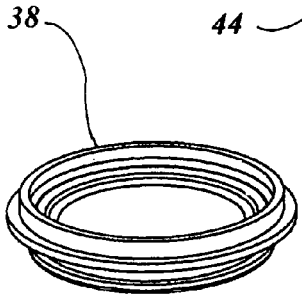
FIG. 12 is an isometric view of the lid bottom cover in the preferred embodiment.
Figure 15:
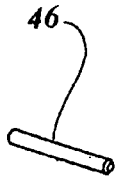
FIG. 15 is an isometric view of the latch dowel pin in the preferred embodiment.

A snap-in hinged spring loaded latch 42 is provided for use as a quick release attachment of the lid 10 and container. The lid body vertical arched handle 40 consists of at least one third of the handle 40 containing the spring loaded latch 42, and the lid body 34 having an integral latch retainer base 44 with the latch 42 hinged to the latch retainer base 44 with a dowel pin 46, preferably made of stainless steel, shown in FIGS. 15 and 17. The snap-in hinged spring loaded latch 44, shown alone in FIG. 12, has a configuration permitting the latch to rotate away from the arched handle 40 allowing a clearance of at least 5/16 inch affording sufficient room for attachment to an object. The latch 42 preferably has a distinctly different color than that of the arched handle 40 for quick identification during usage.

Figure 16:
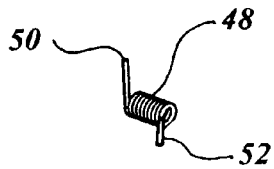
FIG. 16 is an isometric view of the latch tension spring in the preferred embodiment.
Figure 17:
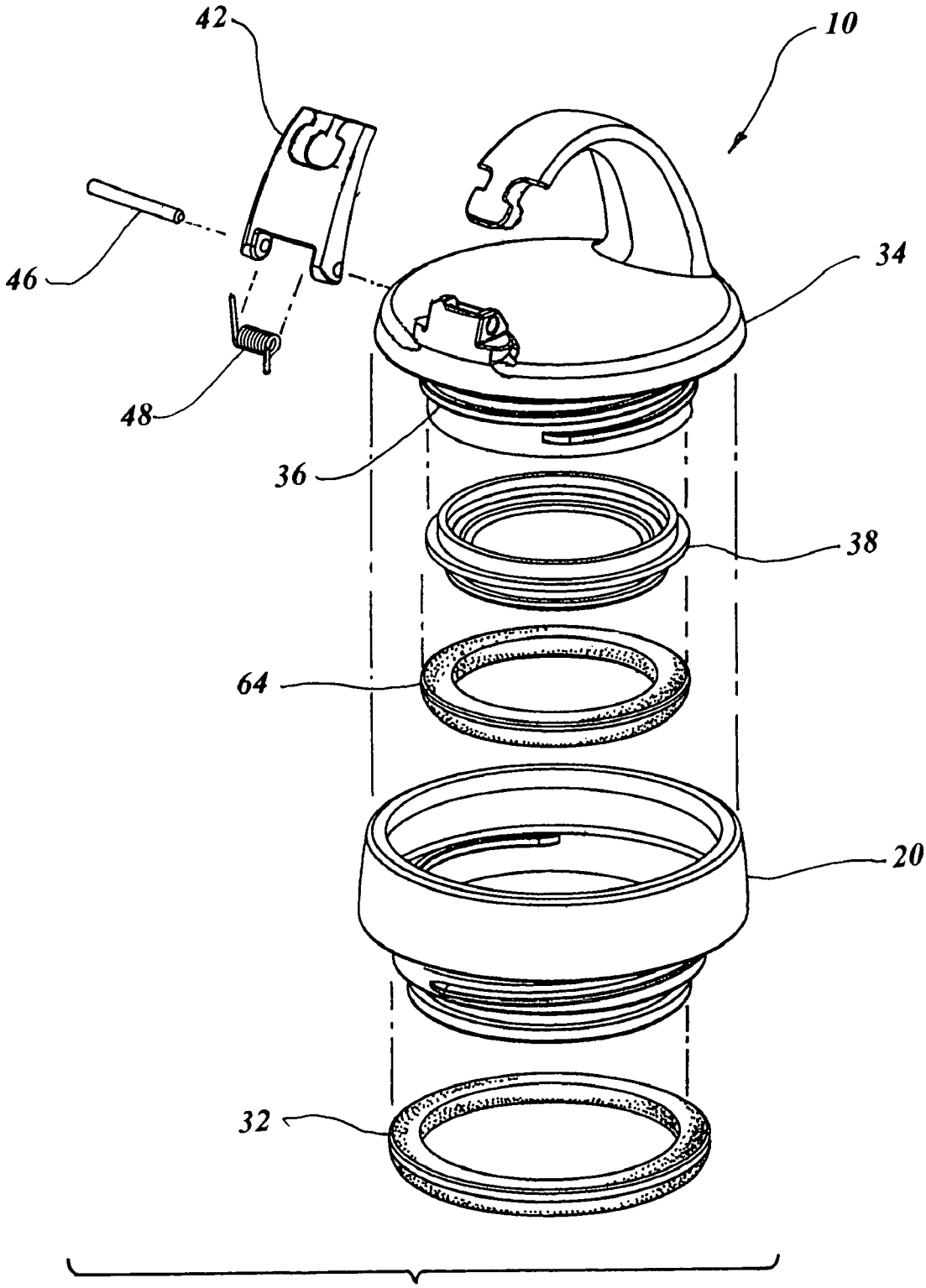
FIG. 17 is an exploded isometric view of the container lid in the preferred embodiment.

A torsion spring 48 applies a compressive load to urge the latch 42 to snap into a closed position, with the spring 48 illustrated in FIGS. 1, 16 and 17. The torsion spring 48 is preferably constructed of stainless steel with a spring first end 50 penetrating the latch 42 and a spring second end 52 penetrating the lid body 34 through the latch retainer base 44.

The arched handle 40 incorporates a tongue configuration 54 on a distal end and the lid latch 42 includes a mating grooved configuration 56, such that when snapped together they jointly retain a contour reproducing the shape of the remainder of the arched handle 40, as shown in FIGS. 1 and 4-8. The tongue configuration 54 has a male mushroom shape 58, and the mating grooved configuration 56 has a female mushroom shape 60 with the female mushroom shape 60 including a web barrier 62, restricting the latch 42 from traveling past the arched handle 40 when snapped together therefore permitting the latch 42 to rest in alignment with the arched handle 40.

Figure 8:
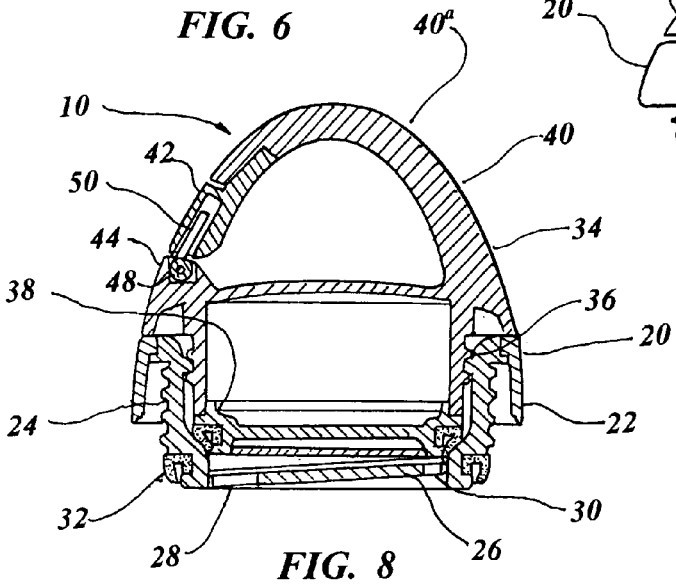
FIG. 8 is a cross sectional view taken along lines 8-8 of FIG. 2.
Figure 9:
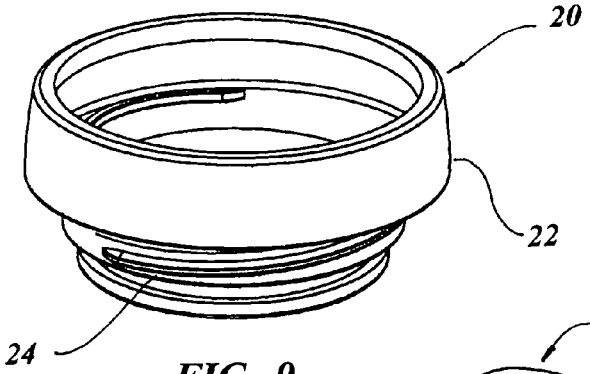
FIG. 9 is an isometric view of the drinking lip in the preferred embodiment.
Figure 10:
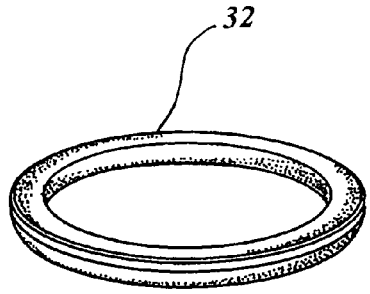
FIG. 10 is an isometric view of the lip sealing ring in the preferred embodiment.
Figure 11:
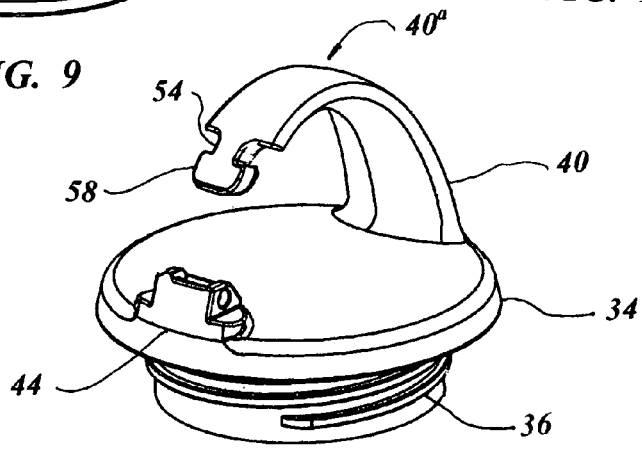
FIG. 11 is an isometric view of the lid body in the preferred embodiment.
Figure 13:
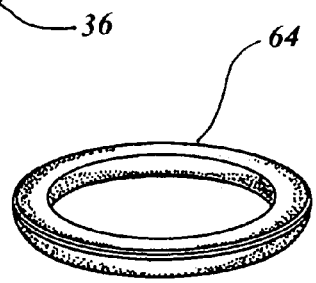
FIG. 13 is an isometric view of the lid sealing ring in the preferred embodiment.
Figure 14:
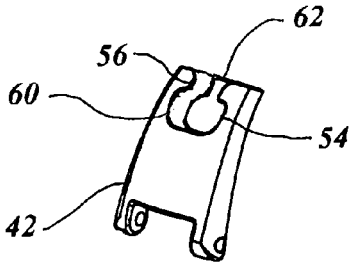
FIG. 14 is an isometric view of the handle latch in the preferred embodiment.

A lid sealing ring 64 is disposed on the lid body 34, as shown in FIGS. 8, 13 and 17, forming a watertight fit between the lid body 34 and the container drinking lip 20, with the lid sealing ring 64 preferably made of a silicone material.

In use, a liquid is poured into the container and the container lid 10 is screwed onto the container with the lip sealing ring 32 creating a watertight seal therebetween. The lid 10 may be attached to an object or article of clothing using the arched handle 40 for the connection, with the latch 42 rotated inwardly to permit clearance of the object and the latch 42 snapped closed by the urging of the torsion spring 48. The user may rotate the drinking lip 20 from the lid body 34 one quarter of a turn and drink from the lip 20 and return the container in reverse to its original position. When finished with its use the latch 42 may be manually rotated inwardly disengaging the lid 10 from the object.

While the invention has been described in complete detail and pictorially shown in the accompanying drawings, it is not to be limited to such details, since many changes and modifications may be made to the invention without departing from the spirit and scope thereof. Hence, it is described to cover any and all modifications and forms which may come within the language and scope of the appended claims.

The invention claimed is:

1. A container lid with a latch handle which comprises;

a drinking lip having a flared brim with the lip configured to interface with a liquid container, wherein said drinking lip further comprises a lip bottom portion having both a liquid aperture and a vent opening with the vent opening located at an opposed location from the liquid aperture, a lip sealing ring disposed within said drinking lip creating a watertight fit between the drinking lip and the container, a lid body having lid male threads configured to interface with said drinking lip having female threads, wherein said lid body male threads are configured to contiguously engage and seal against the drinking lip female threads when the lid body is rotated from 170 degrees to 190 degrees, said lid body having a bottom cover forming an insulated dead air space, said lid body having a vertical arched handle with a snap-in hinged spring loaded latch for quick release attachment of the container lid and container securely to an object, wherein said lid body vertical arched handle consists of at least one third of the handle comprising the spring loaded latch, and said lid body having a latch retainer base with said latch hinged to the latch retainer base with a dowel pin, wherein said snap-in hinged spring loaded latch having a torsion spring applying a compressive load to close the latch into a closed position, and said torsion spring having a stainless steel construction with a spring first end penetrating the latch and a spring second end penetrating the lid body, and a lid sealing ring on said lid body forming a watertight fit between said lid body and said container drinking lip.

2. The container lid with a latch handle as recited in claim 1 wherein said container drinking lip formed from a thermoplastic material selected from the group consisting of acrylic, allyl diglycol carbonate, polycarbonate, polystyrene, polysulfone, polyester sulfone and polyester.

3. The container lid with a latch handle as recited in claim 1 wherein said lip sealing ring is made of a silicone material.

4. The container lid with a latch handle as recited in claim 1 wherein said lid body formed from a thermoplastic material selected from the group consisting of acrylic, allyl diglycol carbonate, polycarbonate, polystyrene, polysulfone, polyester sulfone and polyester.

5. The container lid with a latch handle as recited in claim 1 wherein said dowel pin is made of stainless steel.

6. The container lid with a latch handle as recited in claim 1 wherein said snap-in hinged spring loaded latch has a configuration permitting the latch to rotate away from the arched handle allowing a clearance of at least 5/16 inch affording attached to an object.

7. The container lid with a latch handle as recited in claim 1 wherein said snap-in hinged spring loaded latch having a different color than the arched handle for quick identification during usage.

8. The container lid with a latch handle as recited in claim 1 wherein said lid body vertical arched handle further comprises a parabolic shape with a thickness and width at distal ends larger than at its apex, wherein said vertical arched handle having radial distal ends integrally merging smoothly into the lid body, and the parabolic shape outside surface intersecting with the vertically flared brim of the drinking lip forming a continuation of the parabolic shape.

9. The container lid with a latch handle as recited in claim 1 wherein said lid sealing ring is made of a silicone material.

10. The container lid with a latch handle as recited in claim 1 wherein said lid body vertical arched handle further comprises a tongue configuration on a distal end and said lid body snap-in spring loaded latch having a mating grooved configuration such that when snapped together retain a contour mimicking the shape of the remainder of the arched handle.

11. The container lid with a latch handle as recited in claim 10 wherein said tongue configuration has a male mushroom shape, and said grooved configuration has a female mushroom shape.

12. The container lid with a latch handle as recited in claim 11 wherein said snap-in hinged spring loaded latch grooved female mushroom shape having a web barrier restricting the latch from traveling past the arched handle when snapped together permitting the latch to rest in alignment with the arched handle.

* * * * *